United States Patent [19]

DiMarzio et al.

[11] 4,320,829

[45] Mar. 23, 1982

[54] MERCHANDISE DISPLAY CONTAINER

[75] Inventors: Lawrence P. DiMarzio; Daniel Altilio, both of New York, N.Y.

[73] Assignee: DiMarzio Musical Instrument Pickups, Inc., Staten Island, N.Y.

[21] Appl. No.: 112,300

[22] Filed: Jan. 15, 1980

[51] Int. Cl.[3] ..... B65D 5/50; B65D 1/34

[52] U.S. Cl. ..... 206/45.15; 206/45.33; 206/566

[58] Field of Search ..... 206/45.34, 566, 45.15, 206/45.33; 229/16 D

[56] References Cited

U.S. PATENT DOCUMENTS

| | | | |
|---|---|---|---|
| 1,899,547 | 2/1933 | Addis et al. | 206/45.34 |
| 2,410,161 | 10/1946 | Helbein | 206/45.34 |
| 3,044,605 | 7/1962 | Clement | 206/45.34 |
| 3,746,242 | 7/1973 | Troth | 206/45.34 |
| 3,905,474 | 9/1975 | Haibara | 206/45.33 |
| 3,935,944 | 2/1976 | Wilson et al. | 206/45.34 |

FOREIGN PATENT DOCUMENTS

| | | | |
|---|---|---|---|
| 2032156 | 1/1972 | Fed. Rep. of Germany | 206/45.34 |

*Primary Examiner*—Joseph Man-Fu Moy

*Attorney, Agent, or Firm*—Auslander, Thomas & Morrison

[57] ABSTRACT

A trapezohedral insert converts a parallelipiped transparent plastic container into an effective merchandise display. Merchandise is held in the insert, easily inserted into the container with a minimum of expense for support material and labor.

7 Claims, 4 Drawing Figures

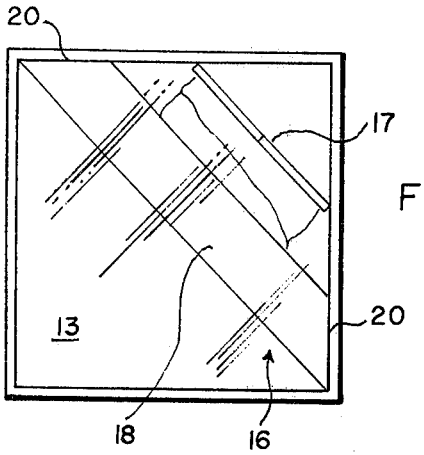
FIG. 2
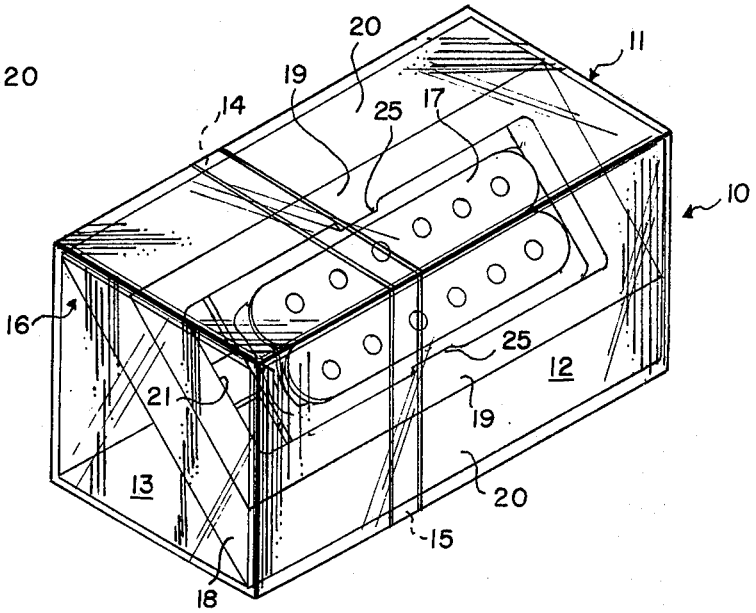
FIG. 1
FIG. 3
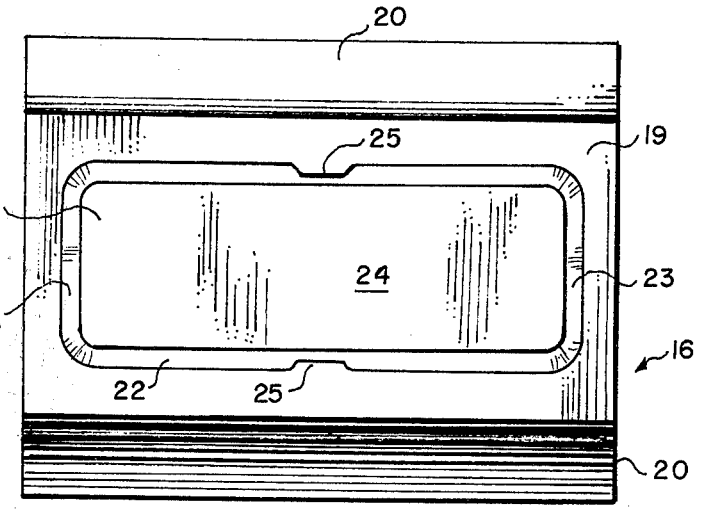
FIG. 4
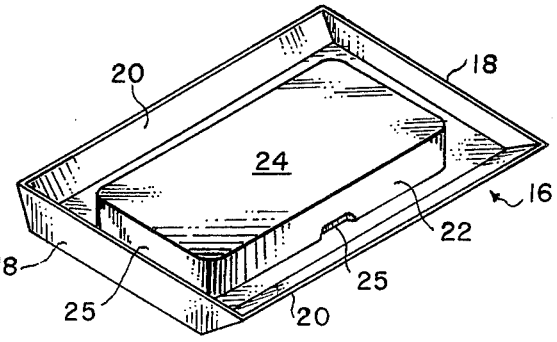

MERCHANDISE DISPLAY CONTAINER

BACKGROUND OF THE INVENTION

The present invention relates to a merchandise display container. Two-piece transparent plastic containers have been popular for the display and containing of merchandise. Such containers comprise a parallelipiped box including a removable transparent overfit top. Thus, unless obstructed by labeling or other extrinsic matter placed in the container, the contents of the container are unobstructedly visible through the clear plastic body of the container from all six sides.

Such containers of the past have been adapted to a variety of merchandise, since different articles have been able to be contained and displayed in many ways. A usual method for containing and displaying merchandise of the past has been to include the article and a printed card, oftentimes of a length extending into the container top, the card covering at least one of the container faces (when closed). In such use of these transparent plastic containers, it was oftentimes necessary, with some merchandise, to provide stuffing material to keep the merchandise from being jostled inside the container. The stuffing might also hold the printed matter, card or other informational matter in place to be visible through the transparent walls of the container.

The stuffings of the containers of the past have included compressible sponge-like material. The use of stuffing inserts of the past entailed the cost of the material, which usually had to fill a good part of the cubic volume of the container, and the labor involved with the manipulation of the stuffing matter to get it and the merchandise satisfactorily into the container.

Various transparent display containers have been provided in the past, such as disclosed in U.S. Pat. No. 2,410,161 to Helbein, where a special inner support for a watch has a transparent cover and end covers which may be slid open to reveal a watch. Nonfunctional trapezohedral shapes have been used in displays of the past for watches, such as shown in U.S. Pat. No. 3,371,772.

SUMMARY OF THE INVENTION

The present invention involves an insert adapted to receive merchandise and adapted to be easily manipulated to be inserted into the rectahedral transparent plastic containers of the past. The present invention includes merchandise containers with their inserts supporting merchandise, protected in many instances against movement of the merchandise displayed over a large portion of the transparent surface of the container, thus effecting optimum support, visibility and economy of parts and labor.

According to the present invention, a parallelipiped transparent plastic display container displays merchandise on an insert supported within the container. The insert is easily insertable in the container with minimal obstruction of the view through the transparent walls of the container.

The insert is preferably a thin plastic sheet, molded or stamped to fit diagonally between two corners of the parallelipiped container and includes walls bracing it against the inner walls of the container. The walls of the insert rigidify the insert to provide strength to the insert without providing bulk. The insert includes a cavity to receive the merchandise and in a preferred embodiment, includes fingers to grasp and firmly hold the merchandise in the insert.

A preferred embodiment includes a merchandise display container with a parallelipiped transparent plastic box having an opening and transparent closure means for the opening. A trapezohedral display insert for the box includes a base no bigger than an inside diagonal of the box in one dimension. The insert has two slanted walls extending toward the hypothetical apex of the trapezohedral insert, abutting the inside of the box, and a transverse wall joining the slanted walls. There is a cavity in the transverse wall to receive merchandise.

Another embodiment includes two further walls forming the sides of the base. The cavity may be defined by a wall integral to the insert and enclosing it. Grasping means such as fingers may extend into the cavity from the insert to hold the merchandise. These grasping fingers are preferably resilient to allow for the effective insertion and removal of the merchandise. It is advantageous for the insert to be a one-piece plastic stamping.

Although such novel feature or features believed to be characteristic of the invention are pointed out in the claims, the invention and the manner in which it may be carried out may be further understood by reference to the description following and the accompanying drawings.

BRIEF DESCRIPTION OF THE DRAWINGS

FIG. 1 is a perspective of the merchandise display container of the present invention including an article of merchandise.

FIG. 2 is a side elevation of FIG. 1.

FIG. 3 is a top plan view of the insert of FIGS. 1 and 2.

FIG. 4 is a bottom perspective view of the insert of FIG. 3.

DETAILED DESCRIPTION OF THE PREFERRED EMBODIMENT

Referring now to the figures in greater detail, where like reference numbers denote like parts in the various figures.

The display container 10 of the present invention comprises a transparent box 11 having a first portion 12 constituting a major container portion and a second portion 13 constituting a cover for the first portion 12. The first portion 12 includes a peripheral lip 14 over which interfits a recessed lip 15 in the second portion 13. Thus, the closed transparent box 11 as shown in FIG. 1 is almost completely transparent without obstruction as the lips 14 and 15 interfit.

In FIGS. 1 and 2 an insert 16 is shown, displaying, in this case, by way of example, an electronic guitar pickup 17.

The insert 16, as can be seen in FIGS. 1 and 2, defines a diagonal across the side of the rectangular cross section of the transparent box 11. The insert 16 is preferably a thin plastic stamping including side walls 18, which are preferably integral to and depending from the upper surface 19, which serves as a transverse wall for the insert 16. Depending walls 20 slant and depend from the upper surface 19, and as shown, are preferably integral to the upper surface 19 and the side walls 18. The cavity 21 extends inward from the upper surface 19, preferably defined by walls 22 on opposite sides, joining walls 23 and an inner wall 24.

As can be seen in FIGS. 2 and 3, fingers 25 extend inward into the cavity 21.

The trapezohedral shape of the insert 16 functions to support the insert 16 diagonally in the transparent box 11 with the walls 20 extending along the length of the insert 16, providing a rigidity against the insert 16 bending along one axis. The walls 18 extending along another length of the insert 16, provide rigidity against bending along another axis. The close abutment of the walls 20 against the inside of the box 11 also rigidifies the insert 16.

In use, an article of merchandise, such as a pickup 17 exemplified herein, is placed in the cavity 21 of the insert 16. The fingers 25 grasp the pickup 17 so that it may be held. The insert 16 may then be slid into the open first portion 12 of the box 11, guided by the walls 20 of the insert 16 and held snugly in the transparent box 11, because the base of the trapezohedral insert 16 is a diagonal of the box 11. The rigidity of the walls 18 maintain the integrity of the diagonal length of the trapezohedral base of the insert 16 in the box 11 by preventing the insert 16 from bending, which also maintains the fingers 25 in place, grasping the pickup 17.

Once the pickup 17 is inserted and the second portion 13 of the box 11 closed, the pickup 17 is plainly displayed through the clear plastic of the box 11.

Where the inner wall 24 of the cavity 21 is integral with the insert 16 and the walls 22, 23, the structure of the cavity 21 reinforces the rigidity of the insert.

The terms and expressions which are employed are used as terms of description; it is recognized, though, that various modifications are possible.

It is also understood the following claims are intended to cover all of the generic and specific features of the invention herein described, and all statements of the scope of the invention which, as a matter of language, might fall therebetween.

Having described certain forms of the invention in some detail, what is claimed is:

1. A merchandise display container comprising a parallelipiped transparent plastic box, a first end of said box being open to provide an opening into an interior of said box which is defined by first, second, third and fourth sides and a second closed end, removable cover means for covering said opening, a trapezohedral display insert for said box, said insert including a display surface adapted for mounting said merchandise thereon, a first slanted wall having a first edge joined along a first edge of said display surface, said first slanted wall having a second edge remote from said first edge, a second slanted wall having a third edge joined along a second edge of said display surface opposed to said first edge, said second slanted wall having a fourth edge remote from said second edge, said first and second slanted walls being disposed at substantially right angles to each other, said insert being slidable through said opening with said first and second slanted walls abutting inside surfaces of said first and second adjacent sides, said second and fourth edges of said first and second slanted walls abutting said third and fourth sides respectively of said box adjacent their respective junctions with said first and second sides, and said surface being supported diagonally to said box by said first and second slanted walls whereby said merchandise is supported by said display insert in a position where it is displayed through said first and second sides of said box.

2. The invention of claim 1 including two further walls depending at right angles from said surface.

3. The invention of claim 1 wherein said surface includes a cavity and said cavity is defined by integral walls in said insert.

4. The invention of claim 2 including grasping means in said cavity for grasping said merchandise.

5. The invention of claim 4 wherein said grasping means include fingers extending into said cavity.

6. The invention of claim 5 wherein said fingers are resilient.

7. The invention of claims 1, 2, 3, 4, 5 or 6 wherein said display insert is a one-piece plastic stamping.

* * * * *